US011224289B1

(12) United States Patent
Hutson

(10) Patent No.: US 11,224,289 B1
(45) Date of Patent: Jan. 18, 2022

(54) SHELF SUPPORT ASSEMBLY

(71) Applicant: DEL HUTSON DESIGNS, LLC, Forney, TX (US)

(72) Inventor: Edward Roland Hutson, Sunnyvale, TX (US)

(73) Assignee: DEL HUTSON DESIGNS, LLC, Forney, TX (US)

( * ) Notice: Subject to any disclaimer, the term of this patent is extended or adjusted under 35 U.S.C. 154(b) by 0 days.

(21) Appl. No.: 16/999,311

(22) Filed: Aug. 21, 2020

(51) Int. Cl.

| | |
|---|---|
| ***A47B 57/46*** | (2006.01) |
| ***A47B 96/14*** | (2006.01) |
| ***A47B 96/06*** | (2006.01) |
| ***A47B 96/02*** | (2006.01) |

(52) U.S. Cl.
CPC ..... *A47B 57/46* (2013.01); *A47B 96/028* (2013.01); *A47B 96/061* (2013.01); *A47B 96/1408* (2013.01)

(58) Field of Classification Search
CPC ..... A47B 57/46; A47B 96/028; A47B 96/061; A47B 96/1408
See application file for complete search history.

(56) References Cited

U.S. PATENT DOCUMENTS 361,111 A 4/1887 Baines
884,503 A 4/1908 Berge
919,526 A 4/1909 Belcher
3,041,033 A * 6/1962 Schwartz ..... A47B 96/061 248/248
3,358,847 A * 12/1967 Magnuson ..... A47G 25/0664 211/189
3,565,020 A * 2/1971 Schier ..... A47B 96/028 108/152
3,602,374 A * 8/1971 Alabaster ..... A47B 57/485 211/193
3,794,183 A * 2/1974 Colbridge ..... B65G 1/026 211/208
4,065,088 A 12/1977 Shell
4,183,487 A * 1/1980 Swain ..... A47B 96/067 248/214
4,205,815 A * 6/1980 Sauer ..... A47B 57/42 211/192

(Continued)

FOREIGN PATENT DOCUMENTS

FR 2850717 A1 * 8/2004 ..... A47B 57/46
FR 2873905 A1 * 2/2006 ..... A47B 96/061

*Primary Examiner* — Stanton L Krycinski
(74) *Attorney, Agent, or Firm* — Fish & Richardson P.C.

(57) ABSTRACT

A shelf support assembly includes a longitudinal post and a shelf bracket. The longitudinal post is attached upright to a vertical surface and includes a front surface that extends from a base of the post. The post includes two opposing longitudinal flanges each extending from a lateral side of the front surface. Each of the two opposing longitudinal flanges include a plurality of concentric flange holes. The shelf bracket is attached in a cantilevered arrangement to the longitudinal post. The shelf bracket includes a support surface and a support arm extending vertically away from an end of the support surface. The support arm includes two opposing arms, each having a concentric arm hole such that, with the shelf bracket attached to the longitudinal post, the concentric arm holes are aligned with a pair of the plurality of concentric flange holes of the longitudinal post.

20 Claims, 3 Drawing Sheets

(56) References Cited

U.S. PATENT DOCUMENTS 4,286,719 A * 9/1981 Hall ..... A47B 57/52 211/190
4,299,368 A 11/1981 Winkler
4,313,587 A * 2/1982 Loeschen ..... A47B 57/56 248/217.2
4,538,784 A 9/1985 O'Flanagan
4,677,794 A 6/1987 Parron et al.
4,895,331 A 1/1990 Nehis
5,069,408 A * 12/1991 Bessinger ..... A47B 96/061 248/250
5,253,835 A * 10/1993 Herron, III ..... A47B 57/30 108/108
5,695,163 A 12/1997 Tayar
6,196,141 B1 * 3/2001 Herron, III ..... A47B 57/42 108/108
6,663,201 B2 * 12/2003 Herron, III ..... A47B 57/42 312/245
6,769,556 B1 8/2004 Holscher
6,776,466 B2 8/2004 Harvie, III
6,962,116 B2 11/2005 Bienick et al.
7,360,627 B2 4/2008 Scott
7,748,674 B2 * 7/2010 Wooten ..... A47B 96/061 248/248
9,398,819 B2 * 7/2016 Tsai ..... A47F 5/101
9,848,844 B2 12/2017 Simon
10,021,972 B1 * 7/2018 Robinson ..... A47B 96/061
10,111,522 B2 * 10/2018 Erlandsson ..... F16B 12/20
10,287,057 B2 * 5/2019 Nilsson ..... A47F 5/101
10,294,679 B2 * 5/2019 Muth ..... F16M 13/022
10,555,604 B2 2/2020 Robinson et al.
10,905,240 B2 * 2/2021 Bowser ..... A47B 5/00
2007/0017888 A1 1/2007 Falvey et al.
2012/0085721 A1 4/2012 Michael et al.
2015/0272348 A1 10/2015 Drake et al.
2016/0007743 A1 1/2016 Koder et al.

* cited by examiner

SHELF SUPPORT ASSEMBLY

TECHNICAL FIELD

This disclosure relates to shelf supports, and more specifically to adjustable shelf brackets.

BACKGROUND

Shelf supports such as shelving assemblies are used to hang items or support weight on a vertical surface. Some shelving assemblies include angle brackets such as L-shaped brackets attached to a rack or a post. Such assemblies can be used to support horizontal shelves in different applications, such as in warehouses, storage rooms, and home cabinets. Improvements to shelving assemblies are continuously sought.

SUMMARY

Implementations of the present disclosure include a shelf support assembly that includes a longitudinal post and a shelf bracket. The longitudinal post is configured to be attached upright to a vertical surface. The longitudinal post includes, with the longitudinal post attached to the vertical surface, a front surface that extends from a base and defies a width and a length. The front surface extends parallel to the vertical surface. The longitudinal post includes two opposing longitudinal flanges each extending from a lateral side of the front surface along the length of the longitudinal post and in a direction perpendicular with respect to the front surface. Each of the two opposing longitudinal flanges include a plurality of concentric flange holes each configured to receive a first mechanical fastener extending through the two opposing longitudinal flanges. The front surface includes one or more apertures configured to receive a second mechanical fastener configured to secure the longitudinal post to the vertical surface. The shelf bracket is configured to be attached in a cantilevered arrangement to the longitudinal post. The shelf bracket includes a generally flat support surface and a support arm extending vertically away from an end of the support surface. The support arm includes a bracket wall extending in a direction perpendicular with respect to the support surface and two opposing arms. Each of the two opposing arms extend away from a lateral side of the bracket wall in a direction perpendicular to the bracket wall. The two opposing arms define a gap therebetween equal to or greater than the width of the front surface of the longitudinal post. Each of the two opposing arms has a concentric arm hole such that, with the shelf bracket attached to the longitudinal post with the first mechanical fastener, the concentric arm holes are aligned with a pair of the plurality of concentric flange holes of the longitudinal post, with the first mechanical fastener extending through the concentric holes and the pair of the plurality of concentric flange holes.

In some implementations, the support arm defines a middle plane orthogonal to and across the bracket wall and the opposing arms. The concentric arm holes are disposed above the middle plane with respect to the support surface such that, with the shelf bracket attached to the longitudinal post, the support surface is below the pair of the plurality of concentric flange holes with respect to the base of the longitudinal post. In some implementations, a center of each of the concentric arm holes are vertically spaced from the support surface a distance of between 1 and 3 inches.

In some implementations, the shelf bracket is an L-shaped bracket with the support surface disposed, with the shelf bracket attached to the longitudinal post, below the opposing arms with respect to the base of the longitudinal post. In some implementations, each of the opposing arms include a bottom surface vertically spaced from the support surface a distance of between 0.1 and 2 inches.

In some implementations, the support surface includes a hole that receives a third mechanical fastener configured to secure a shelf to the support surface.

In some implementations, each of the longitudinal flanges defines a width less than the width of the front surface and a length equal to the length of the front surface, and, with the shelf bracket attached to the longitudinal post, the opposing arms extend from the bracket wall to the vertical surface a distance similar to the width of the longitudinal flanges.

In some implementations, the longitudinal post has a U-shaped cross section and the support arm has a U-shaped cross section corresponding to the U-shaped cross section of the longitudinal post. The opposing arms of the support arm are configured to embrace the longitudinal post.

In some implementations, the vertical surface includes a wall extending from a floor, and the base of the longitudinal post is, with the longitudinal post attached to the wall, spaced from the floor.

In some implementations, the plurality of concentric flange holes are vertically spaced from each other a distance of between 1 and 3 inches. The opposing arms define a length parallel to the length of the longitudinal post, and the length of the opposing arms is equal to or less than the distance between the plurality of concentric holes.

Implementations of the present disclosure include a shelving assembly that includes multiple posts attached to a vertical surface each extending parallel with respect to each other. Each post includes a longitudinal web extending from a base and defining a width and a length and extending parallel to the vertical surface. Each post includes two opposing flanges each extending from a lateral side of the longitudinal web along the length of the post and in a direction perpendicular with respect to the longitudinal web. Each of the two opposing flanges include multiple concentric flange holes each configured to receive a first mechanical fastener extending through the two opposing flanges. The longitudinal web includes one or more holes configured to receive a second mechanical fastener attaching the post to the vertical surface. The shelving assembly also includes L-shaped brackets each attached in a cantilevered arrangement to a respective post at a similar vertical elevation that the other L-shaped brackets with respect to the post. Each L-shaped bracket includes a horizontal arm extending in a direction perpendicular with respect to the longitudinal web of the post and a vertical arm extending in a direction parallel with respect to the longitudinal web. The horizontal arm defines a generally flat support surface and the vertical arm includes a bracket wall and two opposing arms each extending away from a lateral side of the bracket wall in a direction perpendicular with respect to the bracket wall and parallel to the opposing flanges of the post. The two opposing arms define a gap therebetween equal to or greater than the width of the vertical surface of the post. Each of the two opposing arms includes a concentric arm hole such that the concentric arm holes are aligned with a pair of the plurality of concentric flange holes, with the first mechanical fastener extending through the concentric arm holes and the pair of the plurality of concentric flange holes of the post. The shelving assembly also includes a shelf supported on the support surface of each of the plurality of brackets.

In some implementations, the vertical arm defines a middle plane orthogonal to and across the bracket wall and the opposing arms. The concentric arm holes are disposed above the middle plane with respect to the support surface such that the support surface is closer to the base of the post than the concentric arm holes. The vertical arm is at least partially hidden from view behind the shelf. In some implementations, a center of each of the concentric arm holes are vertically spaced from the support surface a distance of between 1 and 3 inches.

In some implementations, each of the opposing flanges defines a width and define a length equal to the length of the longitudinal web. The opposing arms extend from the bracket wall to adjacent the vertical surface a distance similar to the width of the opposing flanges.

In some implementations, the post has a U-shaped cross section and the vertical arm has a U-shaped cross section corresponding to the U-shaped cross section of the post. The opposing arms of the vertical arm are configured to embrace the post.

In some implementations, the vertical surface includes a wall extending from a floor, and the base of the post is spaced from the floor.

In some implementations, the plurality of concentric flange holes are vertically spaced from each other a distance of between 1 and 3 inches. The opposing arms define a length parallel to the length of the post, and the length of the opposing arms is less than the distance between the plurality of concentric holes.

Implementations of the present disclosure include a method of mounting a shelf to a vertical surface. The method includes obtaining a shelf support system that includes a post including a front surface extending from a base and defining a width and a length. The post includes two opposing flanges each extending from a lateral side of the front surface along the length of the post. Each of the two opposing flanges including a plurality of concentric flange holes each configured to receive a first mechanical fastener extending through the two opposing flanges. The front surface includes one or more apertures configured to receive a second mechanical fastener. The shelf support system also includes a shelf bracket including a generally flat support surface and a support arm extending vertically away from an end of the support surface. The support arm includes a bracket wall extending in a direction perpendicular with respect to the support surface and two opposing arms defining a gap therebetween equal to or greater than the width of the front surface of the post. One of the opposing arms includes an arm hole concentric with respect to an arm hole of the other of the arms. The method also includes attaching, with the second mechanical fastener, the post upright to the vertical surface. The method also includes engaging the shelf bracket with the post. Engaging the shelf bracket with the post includes disposing the opposing arms of the support arm about the post. The method also includes aligning the concentric arm holes of the opposing arms with a pair of the plurality of concentric flange holes of the post. The method also includes attaching, with the second mechanical fastener and in a cantilevered arrangement, the shelf bracket to the post, where attaching the shelf bracket to the post includes passing the second mechanical fastener through the concentric holes and the pair of the plurality of concentric flange holes. The method also includes supporting a shelf on the supporting surface of the shelf bracket.

In some implementations, the vertical surface extends from a floor and attaching the post to the vertical surface includes attaching the post to the vertical surface with the base of the post spaced from the floor.

In some implementations, the support arm defines a middle plane orthogonal to and across the bracket wall and the opposing arms. The concentric arm holes are disposed above the middle plane with respect to the support surface. In such implementations, attaching the shelf bracket to the post includes arranging the shelf bracket such that the support surface is closer to the base of the post than the concentric arm holes, and supporting the shelf includes at least partially covering from view, with the shelf, the support arm.

Particular implementations of the subject matter described in this specification can be implemented so as to realize one or more of the following advantages. The disclosed bracket assembly has a post and a bracket that can be quickly installed on a vertical surface with few mechanical fasteners. The bracket has an arm that engages the post, allowing the bracket to be quickly aligned with and attached to the post. The disclosed bracket can be quickly removed from the post to change the height of the bracket with respect to the post. The disclosed L-shaped bracket is arranged to minimize the bending moment applied to the bracket, allowing the bracket to support more weight. The arm that attaches the bracket to the post can be hidden behind the shelf to give the shelving assembly a seamless look, while still being able to support a large amount of weight. The minimal number of holes in the front surface of the post increases the aesthetic appeal of the shelving assembly.

The details of one or more implementations of the subject matter described in this disclosure are set forth in the accompanying drawings and the description herein. Other features, aspects, and advantages of the subject matter will become apparent from the description, the drawings, and the claims.

DETAILED DESCRIPTION

Figure 1:
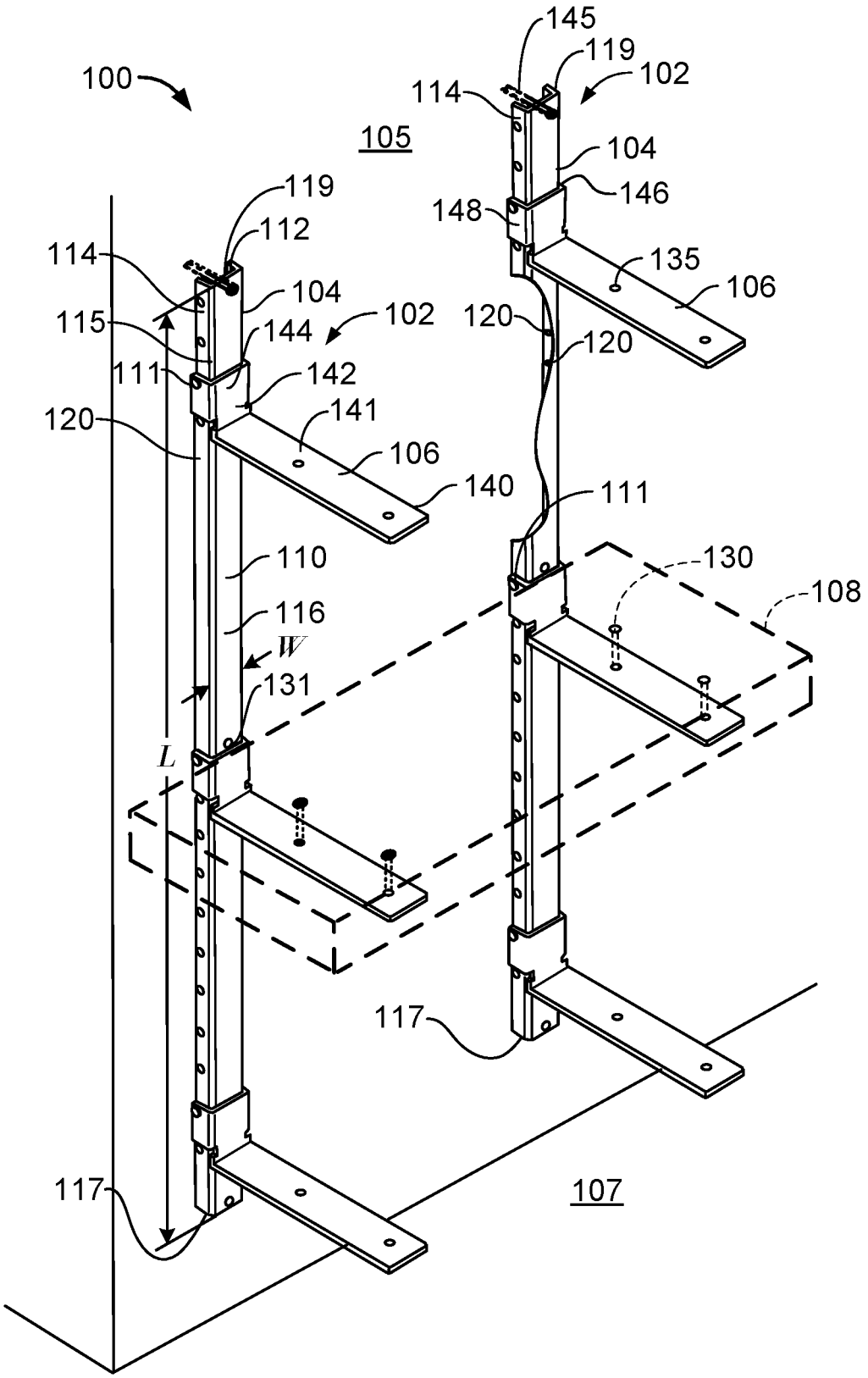
FIG. 1 is a schematic perspective view of a shelving assembly with two shelf support assemblies.

The present disclosure describes a wall-mounted shelving assembly 100 that includes one or more shelf support assemblies 102 or shelf bracket assemblies attached to a vertical surface 105. The vertical surface 105 is illustrated as a wall extending from a floor 107, but the vertical surface 105 can be any appropriate vertical or generally vertical surface such as a door or a surface of a furniture item such as a cabinet or a wardrobe. Each shelf support assembly or system 102 includes a longitudinal post 104 and one or more shelf brackets 106 that are attached (e.g., removably attached) to the longitudinal post 104. Each post has a base 117 that can be spaced from the floor 107 to form a 'floating' shelving assembly. The brackets 106 can be moved along the length of the post 104 to be attached to the post 104 at different elevations with respect to the base 117 of the post 104.

Each longitudinal post 104 is attached upright to the vertical surface 105. Each longitudinal post 104 has a longitudinal web 110 or front wall and two opposing longitudinal flanges 112 and 114 that together form a U-shape cross section. The web 110 defines a front surface 116 that extends from a base 117 of the post 104 to a top end 119 of the post 104. The front surface 116 defines a width W' and a length 'L' that is appropriate for the application or weight of the shelving system. For example, the width W' can be between about 1 and 3 inches (e.g., 1.48 inches) and the length 'L' can be between about 10 and 100 inches (e.g., 36 inches). The width W' and length 'L' of the front surface 116 can be the same as the width and length of the post 104. The front surface 116 extends parallel or generally parallel to the vertical surface 105. The front surface 116 has one or more holes 131 or apertures that receive a second mechanical fastener 145 that secures the post 104 to the vertical surface 105. For example, a post 104 with a length of 36 inches can have three holes 131, with a hole 131 at the center (e.g., 18 inches from the base 117) and one hole 131 adjacent each end of the post 104.

Each of the two opposing longitudinal flanges 112 and 114 extend from a lateral side 115 or end of the front surface 116. The flanges 112 and 114 can extend along the entire length 'L' of the post and extend away from the front surface 116 in a direction perpendicular or generally perpendicular with respect to the front surface 116. Each of the two opposing flanges 112 and 114 has multiple concentric or generally concentric flange holes 120 or apertures. Specifically, the holes 120 of the first flange 112 are concentric, in side view, with the holes 120 of the second flange 114 such that a mechanical fastener 111 extending across a pair of concentric opposing holes 120 extends from the first flange 112 to the second flange 114 horizontally with respect to the floor 107. As shown in the cutaway view of a second post 104 of the two posts, the apertures 120 of the first flange 112 face and are aligned with the apertures 120 of the second flange 114. The mechanical fastener 111 can be a non-permanent fastener such as a pin, a stud, a retaining ring, a screw, or a bolt.

Each shelf bracket 106 is attached in a cantilevered arrangement to the longitudinal post 104. Each shelf bracket 106 can be an L-shape bracket with a horizontal arm 140 extending outwardly from the post 104 and a vertical arm 142 or support arm that extends upwardly (e.g., vertically away) from the horizontal arm 140 with respect to the base 117. The horizontal arm 140 has a flat or generally flat support surface 141 that supports a shelf 108 or otherwise supports a weight of an item (e.g., a basket or a container). The shelf can be attached with a mechanical fastener 130 that extends through a hole 135 of the horizontal arm 140. As further described in detail below with respect to FIGS. 2 and 3, the vertical arm 142 has a vertical bracket wall 144 that extends in a direction perpendicular with respect to the support surface 141 and two opposing arms 146 and 148. Each of the two opposing arms 146 and 148 extend away from a lateral side of the bracket wall 144 in a direction perpendicular with respect to the bracket wall 144 and parallel to the post flanges 112 and 114. Thus, the vertical arm 144 has a U-shape cross section that defines a U-shaped channel that embraces the U-shaped post 104 when attached to the post 104.

Figure 2:
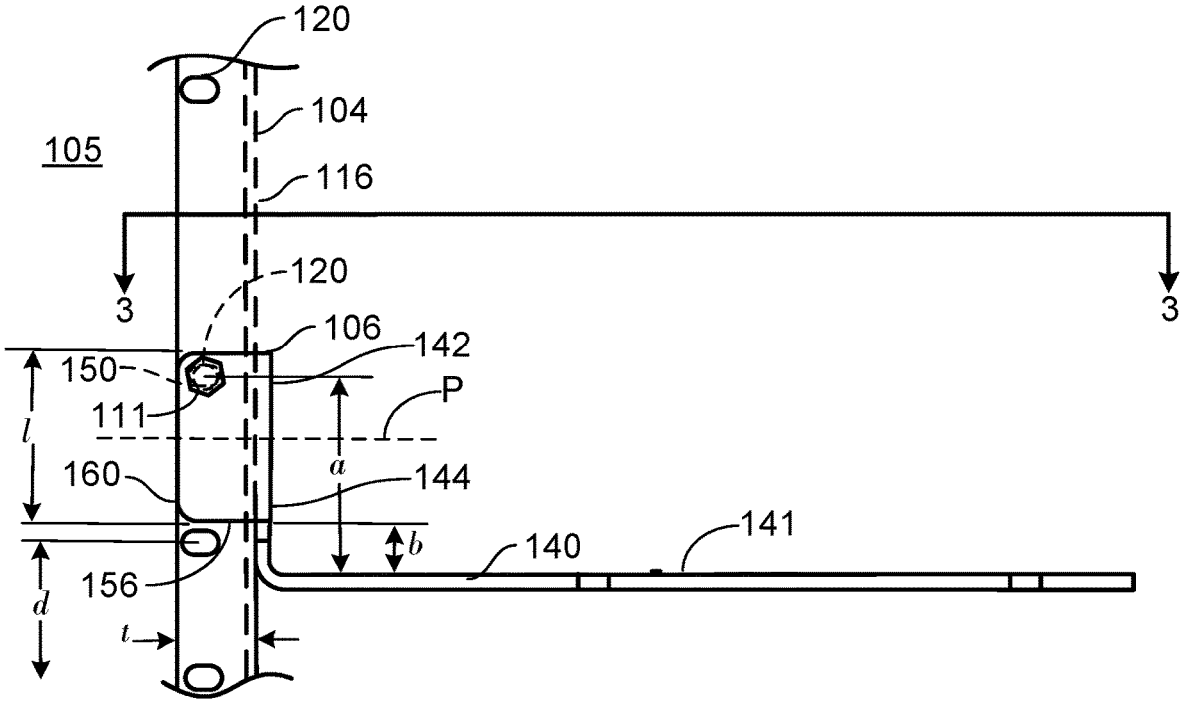
FIG. 2 is a side view of a portion of a shelf support assembly in FIG. 1.
Figure 3:
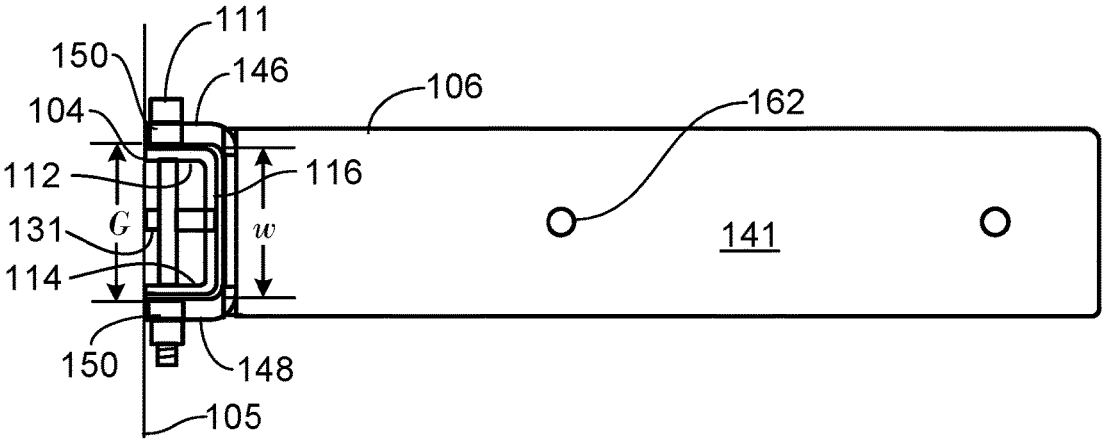
FIG. 3 is a top cross sectional view, taken along line 3-3, in FIG. 2.

FIGS. 2 and 3 show a side view of a bracket 106 attached, with the mechanical fastener 111, to the longitudinal post 104. Referring to FIG. 3, the two opposing arms 146 and 148 define a gap 'G' therebetween that is equal to or greater than the width 'w' of the front surface 116 of the post 104. For example, the width 'w' of the post can be 1.48 inches and the gap 'G' can be between about 1.48 and 1.55 inches (e.g., 1.52 inches) so that the post 104 fits snuggly within the arms 146 and 148 of the bracket 106. Referring also to FIG. 2, each arm 146 and 148 has a concentric or generally concentric arm hole 150 that is aligned with a pair of the concentric holes 120 of the opposing flanges 112 and 114 when the bracket 106 is attached to the post 104. The mechanical fastener 111 extends through the concentric holes 150 of the arms 146 and 148 and the pair of concentric holes of the flanges 112 and 114.

As shown in FIG. 2, the support arm 142 defines a middle plane 'P' orthogonal to and across the bracket wall 144 and the opposing arms 146 and 148. The middle plane 'P' extends along a line of symmetry of the opposing arms 146 and 148. The concentric arm holes 150 reside above the middle plane 'P' with respect to the support surface 141 (or the base 117 of the post 104) such that the support surface 141 is below the pair of concentric flange holes 120 with respect to the base 117 of the post 104. For example, a center of each of the concentric arm holes 150 is vertically spaced from the support surface 141 a distance 'a' of about between 1 and 3 inches (e.g., 1.8 inches), depending on the length of the support arm 142. Distance 'a' may be large enough to increase the weight capacity of the bracket while being small enough to allow the arm 142 to be hidden from view by the shelf 108 (see FIG. 1). The opposing arms 146 and 148 can have a length 'l' of about between 1 and 3 inches (e.g., 1.5 inches) and the bracket wall 144 can have a length that is larger than the length 'l' of the arms 146 and 148. For example, the support surface 141 of the bracket 106 is disposed below the opposing arms 146 and 148 so that a bottom surface 156 of the arms 146 and 148 is vertically spaced from the support surface 141 a distance 'b' of between 0.1 and 2 inches (e.g., 0.5 inches). In some implementations, the bracket wall 144 has the same length as the arms so that the support surface 141 and the bottom surface 156 of the arms 146 and 148 are coplanar.

The concentric flange holes 120 are vertically spaced from each other, from center to center, a distance 'd' of between about 1 and 3 inches (e.g., 1.51 inches). The length 'l' of the arms 146 and 148 can be equal to or less than the distance between the concentric flange holes 120. The longitudinal flanges 112 and 114 have a width that is equivalent to the thickness 't' of the post 104. The thickness 't' can be less than the width 'W' of the front surface 116 of the post 104. For example, the thickness 't' can be between about 0.5 and 1.5 inches (e.g., 0.715 inches). The opposing arms 146 and 148 extend from the bracket wall 144 to the vertical surface 105 a distance similar to the thickness 't' of the post 104. For example, a far end 160 of the arms 146 and 148 can contact or be adjacent to the vertical surface 105. As shown in FIG. 3, the support surface 141 has one or more holes 162 that receive a mechanical fastener that secures a shelf to the support surface 141.

It is theorized that the L-shaped bracket with holes 150 disposed above the middle plane 'P' allows the bracket to transmit a large amount of the weight of the shelf to the post 104 and the vertical surface 105 by minimizing or eliminating the large bending moments that some straight-cantilevered beam brackets experience. Additionally, as shown in FIG. 1, the vertical arm 142 extending upwardly (e.g., in the direction of the shelf 108) allows the vertical arm 142 to be hidden behind the shelf 108 to give the shelving assembly a seamless look, while still being able to hold a large weight.

Figure 4:
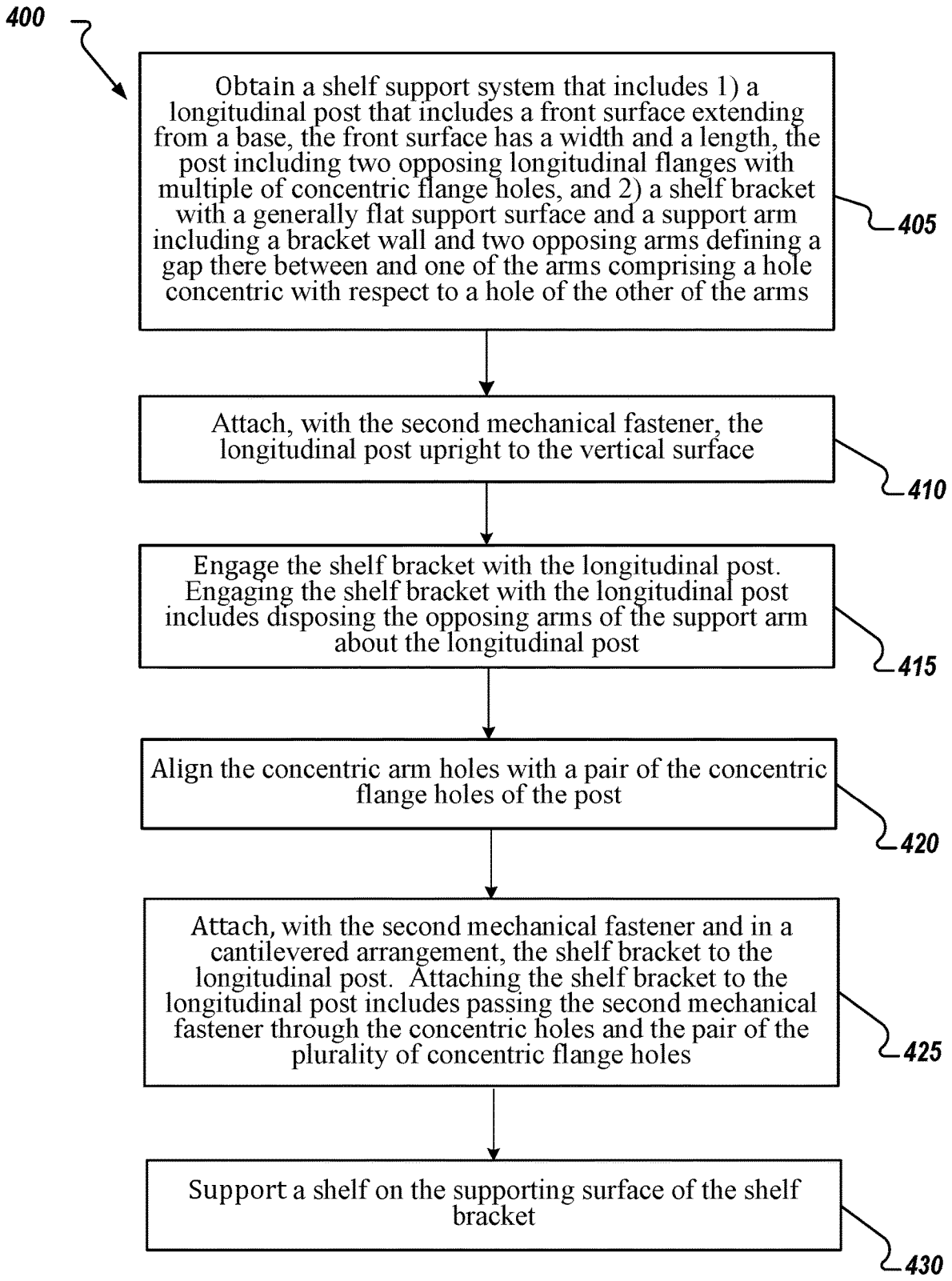
FIG. 4 is a flow chart of an example method of mounting a shelf to a vertical surface.

FIG. 4 shows a flow chart of an example method 400 of mounting a shelf to a vertical surface. The method includes obtaining a shelf support system that includes 1) a longitudinal post that includes a front surface extending from a base, the front surface has a width and a length, the post including two opposing longitudinal flanges with multiple of concentric flange holes and the front surface including one or more apertures configured to receive a second mechanical fastener, and 2) a shelf bracket with a generally flat support surface and a support arm extending vertically away from an end of the support surface, the support arm including a bracket wall extending in a direction perpendicular with respect to the support surface and two opposing arms defining a gap therebetween equal to or greater than the width of the front surface of the post and one of the arms comprising a hole concentric with respect to a hole of the other of the arms (405). The method also includes attaching, with the second mechanical fastener, the longitudinal post upright to the vertical surface (410). The method also includes engaging the shelf bracket with the longitudinal post. Engaging the shelf bracket with the longitudinal post includes disposing the opposing arms of the support arm about the longitudinal post (415). The method also includes aligning the concentric arm holes with a pair of the concentric flange holes of the post (420). The method also includes attaching, with the second mechanical fastener and in a cantilevered arrangement, the shelf bracket to the longitudinal post. Attaching the shelf bracket to the longitudinal post includes passing the second mechanical fastener through the concentric holes and the pair of the plurality of concentric flange holes (425). The method also includes supporting a shelf on the supporting surface of the shelf bracket (430).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A shelf support assembly comprising:

a longitudinal post configured to be attached upright to a vertical surface, the longitudinal post comprising, with the longitudinal post attached to the vertical surface, a front surface extending from a base and defining a width and a length and extending parallel to the vertical surface, the longitudinal post comprising two opposing longitudinal flanges each extending from a lateral side of the front surface along the length of the longitudinal post and in a direction perpendicular with respect to the front surface, each of the two opposing longitudinal flanges comprising a plurality of concentric flange holes each configured to receive a first mechanical fastener extending through the two opposing longitudinal flanges, the front surface comprising one or more apertures configured to receive a second mechanical fastener configured to secure the longitudinal post to the vertical surface; and a shelf bracket configured to be attached in a cantilevered arrangement to the longitudinal post, the shelf bracket comprising a generally flat support surface and a support arm extending vertically away from an end of the support surface, the support arm comprising a bracket wall extending in a direction perpendicular with respect to the support surface and two opposing arms, each of the two opposing arms extending away from a lateral side of the bracket wall in a direction perpendicular to the bracket wall, the two opposing arms defining a gap therebetween equal to or greater than the width of the front surface of the longitudinal post and each comprising a concentric arm hole such that, with the shelf bracket attached to the longitudinal post with the first mechanical fastener, the concentric arm holes are aligned with a pair of the plurality of concentric flange holes of the longitudinal post, with the first mechanical fastener extending through the concentric holes and the pair of the plurality of concentric flange holes, and such that the shelf bracket is mechanically attached to the longitudinal post only by the first mechanical fastener.

2. The shelf support assembly of claim 1, wherein the shelf bracket is an L-shaped bracket with the support surface disposed, with the shelf bracket attached to the longitudinal post, below the opposing arms, the support arm defines a middle plane orthogonal to and across the bracket wall and the opposing arms, the concentric arm holes disposed above the middle plane with respect to the support surface such that, with the shelf bracket attached to the longitudinal post, the support surface is below the pair of the plurality of concentric flange holes with respect to the base of the longitudinal post.

3. The shelf support assembly of claim 2, wherein a center of each of the concentric arm holes are vertically spaced from the support surface a distance of between 1 and 3 inches.

4. The shelf support assembly of claim 1, wherein the shelf bracket is an L-shaped bracket with the support surface disposed, with the shelf bracket attached to the longitudinal post, below the opposing arms with respect to the base of the longitudinal post.

5. The shelf support assembly of claim 4, wherein each of the opposing arms comprise a bottom surface vertically spaced from the support surface a distance of between 0.1 and 2 inches.

6. The shelf support assembly of claim 1, wherein the support surface comprises a hole that receives a third mechanical fastener configured to secure a shelf to the support surface.

7. The shelf support assembly of claim 1, wherein each of the longitudinal flanges defines a width less than the width of the front surface and a length equal to the length of the front surface, and, with the shelf bracket attached to the longitudinal post, the opposing arms extend from the bracket wall to the vertical surface a distance equal to or less than the width of the longitudinal flanges.

8. The shelf support assembly of claim 1, wherein the longitudinal post has a U-shaped cross section and the support arm has a U-shaped cross section corresponding to the U-shaped cross section of the longitudinal post, the opposing arms of the support arm configured to embrace the longitudinal post.

9. The shelf support assembly of claim 1, wherein the vertical surface comprises a wall extending from a floor, and wherein the base of the longitudinal post is, with the longitudinal post attached to the wall, spaced from the floor.

10. The shelf support assembly of claim 1, wherein the plurality of concentric flange holes are vertically spaced from each other a distance of between 1 and 3 inches, the opposing arms defining a length parallel to the length of the longitudinal post, and the length of the opposing arms is equal to or less than the distance between the plurality of concentric holes.

11. A shelving assembly comprising:

a plurality of posts attached to a vertical surface each extending parallel with respect to each other, each post comprising a longitudinal web extending from a base and defining a width and a length and extending parallel to the vertical surface, each post comprising two opposing flanges each extending from a lateral side of the longitudinal web along the length of the post and in a direction perpendicular with respect to the longitudinal web, each of the two opposing flanges comprising a plurality of concentric flange holes each configured to receive a first mechanical fastener extending through the two opposing flanges, the longitudinal web comprising one or more holes configured to receive a second mechanical fastener attaching the post to the vertical surface;

a plurality of L-shaped brackets each attached in a cantilevered arrangement to a respective one of the posts at a vertical elevation equal to a vertical elevation of another one of the respective L-shaped brackets with respect to the post, each L-shaped bracket comprising a horizontal arm extending in a direction perpendicular with respect to the longitudinal web of the post and a vertical arm extending in a direction parallel with respect to the longitudinal web, the horizontal arm defining a generally flat support surface and the vertical arm comprising a bracket wall and two opposing arms each extending away from a lateral side of the bracket wall in a direction perpendicular with respect to the bracket wall and parallel to the opposing flanges of the post, the two opposing arms defining a gap therebetween equal to or greater than the width of the vertical flanges of the post and each comprising a concentric arm hole such that the concentric arm holes are aligned with a pair of the plurality of concentric flange holes, with the first mechanical fastener extending through the concentric arm holes and the pair of the plurality of concentric flange holes of the post such that, with each L-shaped bracket attached to the respective post, each L-shaped bracket is attached to the respective post only by the first mechanical fastener; and a shelf supported on the support surface of each of the plurality of brackets.

12. The shelving assembly of claim 11, wherein the vertical arm defines a middle plane orthogonal to and across the bracket wall and the opposing arms, the concentric arm holes disposed above the middle plane with respect to the support surface such that the support surface is closer to the base of the post than the concentric arm holes, and the vertical arm is at least partially hidden from view behind the shelf.

13. The shelving assembly of claim 12, wherein a center of each of the concentric arm holes are vertically spaced from the support surface a distance of between 1 and 3 inches.

14. The shelving assembly of claim 11, wherein each of the opposing flanges defines a width and define a length equal to the length of the longitudinal web, and the opposing arms extend from the bracket wall to adjacent the vertical surface a distance equal to or less than the width of the opposing flanges.

15. The shelving assembly of claim 11, wherein the post has a U-shaped cross section and the vertical arm has a U-shaped cross section corresponding to the U-shaped cross section of the post, the opposing arms of the vertical arm configured to embrace the post.

16. The shelving assembly of claim 11, wherein the vertical surface comprises a wall extending from a floor, and wherein the base of the post is spaced from the floor.

17. The shelving assembly of claim 11, wherein the plurality of concentric flange holes are vertically spaced from each other a distance of between 1 and 3 inches, the opposing arms defining a length parallel to the length of the post, and the length of the opposing arms is less than the distance between the plurality of concentric holes.

18. The shelf support assembly of claim 1, wherein the longitudinal post does not comprise apertures configured to receive and engage a feature of the shelf bracket.

19. The shelf support assembly of claim 18, wherein the shelf bracket is attachable to the longitudinal post absent hooks configured to engage the longitudinal post.

20. The shelf support assembly of claim 19, wherein the first mechanical fastener comprises a bolt and nut assembly.

* * * * *